US007131536B2

(12) United States Patent
Gordon et al.

(10) Patent No.: US 7,131,536 B2
(45) Date of Patent: Nov. 7, 2006

(54) OVERCAP PACKAGING DEVICE FOR DISC-SHAPED ITEMS AND RELATED MATERIALS AND METHOD FOR PACKAGING SUCH DISCS AND MATERIAL

(75) Inventors: Alexandra Gordon, Bedford, NY (US); Charles W. Grimes, Darien, CT (US); William L. Plumb, Piermont, NY (US)

(73) Assignee: Avecmedia, Inc., Norwalk, CT (US)

( * ) Notice: Subject to any disclaimer, the term of this patent is extended or adjusted under 35 U.S.C. 154(b) by 519 days.

(21) Appl. No.: 10/155,264

(22) Filed: May 24, 2002

(65) Prior Publication Data

US 2004/0217033 A1 Nov. 4, 2004

Related U.S. Application Data

(60) Continuation-in-part of application No. 09/950,732, filed on Sep. 12, 2001, now Pat. No. 6,464,072, and a continuation-in-part of application No. 09/702,266, filed on Oct. 31, 2000, now Pat. No. 6,533,114, which is a division of application No. 09/161,064, filed on Sep. 25, 1998, now Pat. No. 6,216,857.

(51) Int. Cl.
*B65D 85/57* (2006.01)

(52) U.S. Cl. ..... 206/493; 206/216; 206/307; 220/521

(58) Field of Classification Search ..... 53/471; 206/217, 232, 303, 307, 307.1, 308.1, 308.3, 206/310; 220/212, 521, 522; 215/227
See application file for complete search history.

(56) References Cited

U.S. PATENT DOCUMENTS 1,464,827 A * 8/1923 Morrison ..... 206/216
1,940,088 A * 12/1933 Harrison ..... 206/408
2,015,028 A * 9/1935 Gillette ..... 40/307
2,020,381 A * 11/1935 Labowitz et al. ..... 206/216
3,746,158 A * 7/1973 Connick ..... 426/120

(Continued)

*Primary Examiner*—Jila M. Mohandesi
(74) *Attorney, Agent, or Firm*—Grimes & Battersby, LLP

(57) ABSTRACT

A packaging device is provided for packaging at least one disc-shaped item such as a CD-ROM or a DVD. The packaging device includes a first member for the storage of disc-shaped media in a chamber or cavity, which container may be attached to storage devices of various shapes and sizes for the storage of materials other than the disc-shaped media. The chamber includes means for maintaining the disc-shaped media in a stable state within the chamber, such that the disc-shaped media is allowed to rotate, while limiting the linear movement of the disc-shaped media both perpendicular to and parallel to the plane of the media. The disc-shaped media may be sealed within the inner chamber by means of either a circular protective element or by means of a complementary cap or lid adapted to engage the first member. The first member is attached to the storage device by means of engagement of the first member with the top of or cover to the package or packages. In such device, the first member and disc-shaped media may be of a larger diameter than one dimension of the top of or cover to the package or packages. Alternatively, the first member may engage and hold in positive juxtaposition multiple packages. The first member includes a protective element along the perimeter thereof to ensure the integrity of the first member as well as to prevent the edges of the disc-shaped media from being damaged. A method is further provided for packaging such disc-shaped item and other material within the packaging device.

55 Claims, 15 Drawing Sheets

U.S. PATENT DOCUMENTS 4,535,888 A * 8/1985 Nusselder ..... 206/311
4,869,364 A * 9/1989 Bray ..... 206/232
5,284,243 A * 2/1994 Gelardi et al. ..... 206/308.1
5,542,531 A * 8/1996 Yeung ..... 206/308.1
5,697,498 A * 12/1997 Weisburn et al. ..... 206/308.1
5,816,394 A * 10/1998 O'Brien et al. ..... 206/308.1
5,819,929 A * 10/1998 Chung ..... 206/308.1
5,904,266 A * 5/1999 Tedeschi, Jr. ..... 220/521
5,906,290 A * 5/1999 Haberkorn ..... 220/505
6,070,752 A * 6/2000 Nava et al. ..... 220/521
6,112,891 A * 9/2000 Wohl et al. ..... 206/223
6,443,299 B1 * 9/2002 Kuremoto et al. ..... 206/308.1

* cited by examiner

OVERCAP PACKAGING DEVICE FOR DISC-SHAPED ITEMS AND RELATED MATERIALS AND METHOD FOR PACKAGING SUCH DISCS AND MATERIAL

RELATED APPLICATIONS

This is a continuation-in-part of U.S. application Ser. No. 09/950,732, filed Sep. 12, 2001 now U.S. Pat. No. 6,464,072 and this is a continuation-in-part of U.S. patent aplication Ser. No. 09/702,266 filed on Oct. 31, 2000 in the names of Alexandra Gordon and Charles W. Grimes for "Packaging Device for Disc-Shaped Items and Related Materials and Method for Packaging Such Disks and Material" now U.S. Pat. No. 6,533,144, which, in turn, was a divisional of U.S. patent application Ser. No. 09/161,064 filed on Sep. 25, 1998 in the names of Alexandra Gordon and Charles W. Grimes for "Packaging Device for Disc-Shaped Items and Related Materials and Method for Packaging Such Disks and Material" which subsequently issued on Apr. 17, 2001 as U.S. Pat. No. 6,216,857.

BACKGROUND OF THE INVENTION

1. Field of the Invention

This invention relates, in general, to a device for packaging and displaying a circular or disc-shaped media and other materials and a method for packaging such disc-shaped media and other materials and, in particular to containers and methods for initially packaging and thereafter repeatedly storing disc-shaped media together with other materials stored in containers of various sizes.

Still more particularly, the present invention further relates to a new and improved device for initially packaging and thereafter repeated storing of a disc-shaped media including a support element to receive and retain said disc-shaped media and means for attaching the packaging device to containers of varying sizes.

2. Background of the Invention

Packaging and storage devices for media are generally known. Disc-shaped media, such as CD's, DVD's or CD-ROM's, encounter special problems in handling, packaging and storage due to their delicate, flat recorded surfaces. Such disc-shaped media is generally sold in plastic cases which are sometimes referred to as "jewel boxes." Such cases are generally rectangular and have a mounting hub for holding the disc-shaped media by its center aperture. Such cases are usually kept after purchase of the disc-shaped media and utilized for re-packaging, of the disc-shaped media between usage. Such jewel boxes are impractical packaging containers for shipping because of their small dimensions and easy breakage, and they thus require substantial additional packaging material or placement in larger shipping containers.

Disc-shaped media is routinely sold with other materials (whether directly related to the content of the disc-shaped media, i.e., ancillary, or otherwise). At the present time, disc-shaped media in such "jewel boxes" is commonly packaged together with ancillary materials in larger rectangular shaped cardboard boxes for shipping, sale and packaging. The "jewel boxes" are necessary to reliably protect the disc-shaped media from contact with the ancillary materials in the larger cardboard boxes. Such plastic case/cardboard box combination package arrangements are not only expensive, they also do not lend themselves to easy and secure repeated re-storage of the disc-shaped media and ancillary materials. They are often damaged during initial opening and repeated re-storage. They are often unable after initial opening to securely re-store the disc-shaped media (in the jewel box) and the other materials together in the cardboard packaging in a manner to preclude contact with each other. They frequently become unsightly after initial opening and repeated re-storage. They are, themselves, difficult to handle and store.

Other types of packaging and storage devices are needed to organize, protect, ship, display at retail and store disc-shaped media sold and/or shipped in combination with ancillary materials.

A need also exists for devices which can effectively and efficiently organize, protect, ship, display at retail and store disc shaped media with other materials.

An opportunity exists that is not being commercially exploited at the present time to distribute disc-shaped recording media with materials that are either ancillary or wholly unrelated to the content of the disc-shaped media. This opportunity is not being exploited due to the lack of an effective container design and method for efficiently organizing, protecting, shipping, displaying at retail and storing disc-shaped media packaged with other materials.

SUMMARY OF THE INVENTION

The primary object of this invention is to provide a container in which and a method whereby disc-shaped media and ancillary materials stored in packages of various shapes and sizes can initially be packaged together in stacked relationship and, after removal and use, can easily be re-stored in stacked relationship in a manner so as to avoid contact there between.

Another object of this invention is to provide a container and method of packaging whereby the container and the disc-shaped media may be larger in area than the package or packages wherein the other material is stored.

Still another object of this invention is to provide a container and method of packaging whereby the disc-shaped media is protected from damage to its edges.

Yet another object of this invention is to provide a container and method of packaging whereby the container is formed using an injection molding process whereby the dimensions and structures of the upper portion of the container remains constant while the dimensions and structures of the bottom portion may be varied depending upon the size of the package or packages to which the container will be attached.

Another object of the present invention is to provide a container that may be attached to the package or packages by sliding the container over the top or the cap of the package or packages.

Still another object of this invention is to provide a container and a method of packaging that eliminates the need for a separate case (i.e., the need for a "jewel box") for the disc-shaped media.

Yet another object of this invention is to provide a container and a method of packaging whereby during initial storage, shipping, retail presentation and re-packaging the disc-shaped media is securely held against movement in the planes both parallel and perpendicular to the plane of the disc-shaped media.

Still another object of this invention is to provide a container and a method of packaging whereby during initial storage, shipping, retail presentation and re-packaging the disc-shaped media is protected from contact with the other materials and from external forces.

Another important object of this invention is to provide a shipping container in which and a method of shipping whereby disc-shaped media and other materials can be packaged, presented, conveyed, distributed and stored.

Another important object of this invention is to provide an aesthetically unique and compelling device and method for presenting at retail disc-shaped media and other materials which may or may not be related to the content of the media.

Still another object with this invention is to provide a container and a method packaging whereby the seat and lid are removable and the seat and lid can be combined to create a permanent storage and restoring package for the disc-shaped media alone.

Another object of this invention is to provide a container and a method of packaging whereby a protective insert is placed in the container before the disc-shaped media to protect the disc-shaped media from contact with the other materials.

Another object of this invention is to provide a container and a method of packaging whereby a replaceable protective insert is placed in the container before the disc-shaped media to protect the disc-shaped media from contact with the other materials, which insert can be removed to access the ancillary materials and can be replaced after the ancillary materials are re-stored in the container and before the disc-shaped media is re-stored in the container.

Another object of this invention is to provide a container and method of packaging whereby the first chamber is within the removable lid and the disc-shaped media support member is a center post fixedly attached to and extending from the inside center of the lid.

To accomplish these and other objects, the container of this invention in its preferred form comprises a first member for the storage of disc-shaped media in a chamber or cavity, which container may be attached to storage devices of various shapes and sizes for the storage of materials other than the disc-shaped media. The chamber includes means for maintaining the disc-shaped media in a stable state within the chamber, including a structure defining support for the disc-shaped media whether by means of the annular opening at the center thereof or the perimeter thereof, such that the disc-shaped media is allowed to rotate, while limiting the linear movement of the disc-shaped media both perpendicular to and parallel to the plane of the media. The disc-shaped media may be sealed within the inner chamber by means of either a circular protective element or by means of a complementary cap or lid adapted to engage the first member. The protective element may be affixed by a variety of means, including heat-sealing to either the inner structure or perimeter of the first member, or both, or snapping engagement onto the first member by means of at least one protrusion on either the inner structure or perimeter of the first member, or both. Other attachment means, such as adhesives, or sealing compression fits, are contemplated. The first member may be attached to the storage device by a variety of means including heat sealing, snapping engagement, adhesives or a compression fit whereby the first member is engaged to the top of or cover to the package or packages. In such device, the first member and disc-shaped media may be larger in diameter than one dimension of the top of or cover to the package or packages. The first member includes a protective element along the perimeter thereof to ensure the integrity of the first member as well as to prevent damage to the edges of the disc-shaped media. Alternatively, the first member may engage and hold two or more packages in juxtaposition.

In the preferred method of packaging, disc-shaped media is inserted into and releasably retained within the chamber of the storage device by means of a cylindrical inner structure and sealed therein by means of a protective element. The storage device is then attached to the top of or cap to the package or packages containing the other material.

The above, as well as additional objects, features and advantages of the invention will become apparent in the following detailed description.

BRIEF DESCRIPTION OF THE DRAWINGS

The novel features believed characteristics of the invention are set forth in the appended claims. The invention itself, however, as well as the preferred mode of use, further objects and advantages thereof, will best be understood by reference to the following detailed description of illustrative embodiment when read in conjunction with the accompanying drawings, wherein:

DETAILED DESCRIPTION OF THE INVENTION

Figure 1:
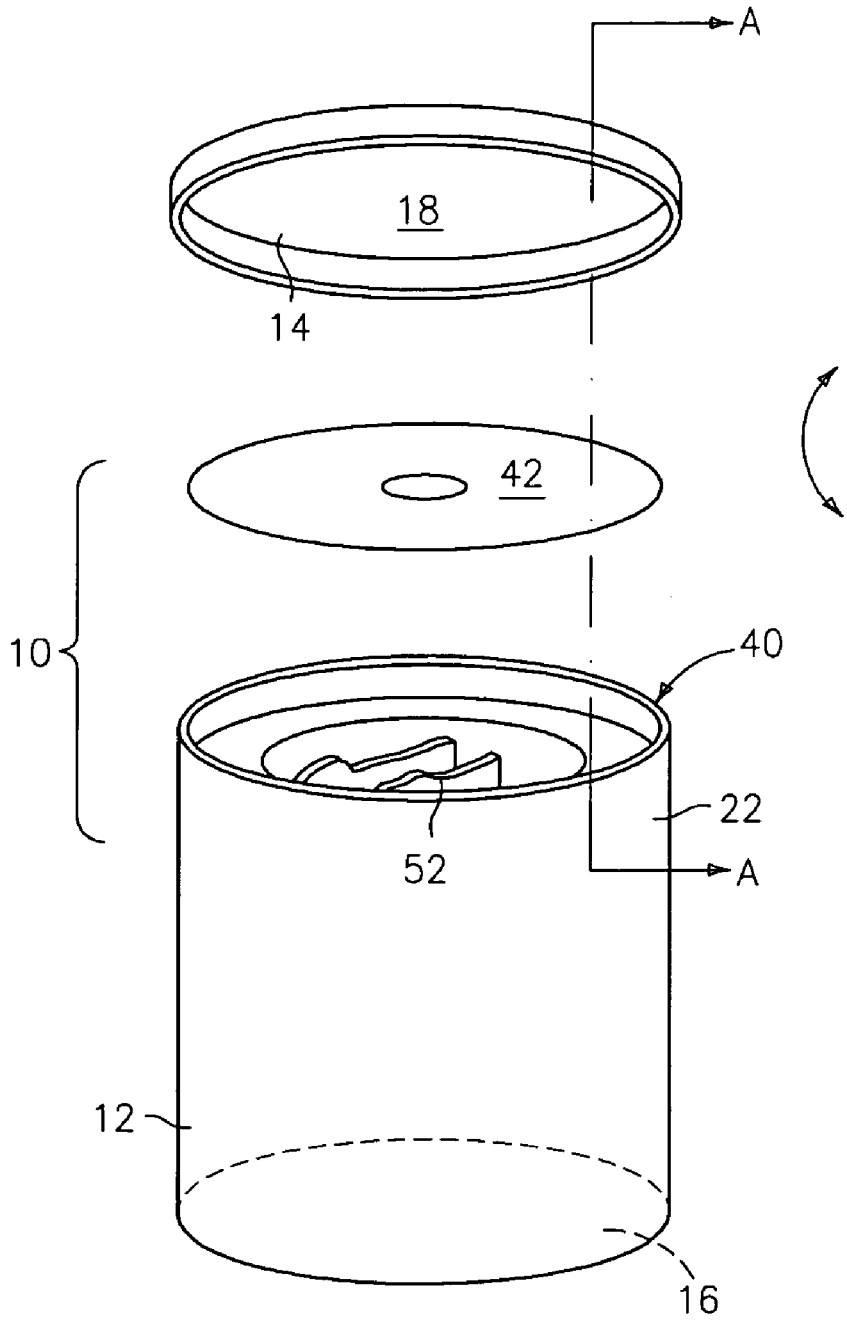
FIG. 1 is an exploded perspective view of the novel disc packaging device of the present invention with the lid and disk media removed, illustrating the use of a one-piece annular collar member with an annular ring and lip.

With reference now to the figures and in particular with reference to FIG. 1, there is shown a front view of the disc packaging device 10 of the present invention. As illustrated, disc packaging device 10 includes a lower base component or container 12 and an upper cover component or lid 14. Lower base component 12 and upper cover component 14 are utilized to form a generally cylindrical packaging device of dimension slightly larger than the disc shaped recording media to be stored. End plates 16 and 18 cooperate with lower base component 12 and upper cover component 14 to fully enclose the cylindrical packaging space defined thereby.

Figure 2:
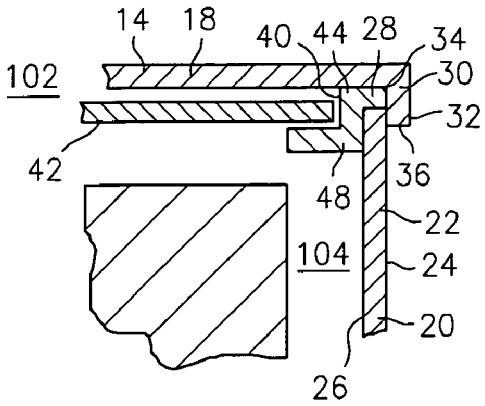
FIG. 2 is a cut-away, cross-sectional side view of a portion of the novel disc packaging device of FIG. 1 when the lid is on the container, along line AA illustrating the resultant first and second chambers thereof.

The lower base component 12 of the embodiment of this invention shown in FIGS. 1 and 2 includes a side wall 20. The side wall can be constructed from either cardboard (i.e., natural fiber material) or plastic (i.e., man-made synthetic material) or other material suitably rigid for the base component to retain its shape, including metal, e.g., as in a vacuum sealed, canned product.

The base component 12 can be designed to threadably receive the bottom plate 16 which is of conventional design, made of stiff cardboard, plastic, metal or some similarly rigid material and used as a cover-all screw cap on a very wide variety of containers. Alternatively the bottom plate 16 can nest inside the side wall 20 where it is held by friction, stapling, gluing or some other means. The side wall 20 has an upper section 22 and the upper section 22 can be threaded to accommodate the upper cover component 14 although in the embodiment shown in FIGS. 1 and 2 the cover is made of plastic and snaps on in a conventional manner.

As best seen in FIG. 2, the upper section 22 is defined by an outer wall 24, an inner wall 26 and a rim 28. The cover component 14 has a side wall 30 defined by an outer wall 32, an inner wall 34 and a rim 36. The diameter of the inner wall 34 of the cover component is slightly greater than the diameter of the outer wall 24 of the base component. In the embodiment shown in FIGS. 1 and 2, there is an inner structure 40 which provides circumferential support for a disc shaped media 42 stored within the packaging device 10. The structure 40 comprises an annular collar 44 having an annular ring 46 and an annular lip 48. The inner structure 40 nests within the lower base component 12. The annular collar 44 has an outer diameter greater than the diameter of the inner wall 26 of the base component such that the annular collar extends beyond the inner wall 26 and sits on top of the base rim 28. The annular ring 46 has an outer diameter less than the diameter of the inner wall 26, such that the annular ring nests inside the inner wall 26. The annular lip 48 has an inner diameter less than the outer diameter of the disc shaped media 42. Thus, the disc shaped media will rest on the annular lip, inside the annular ring. In this way, movement of the disc shaped media in the plane of the disc shaped media is precluded by the annular abutment 46. Movement of the disc shaped media perpendicular to its plane is prevented in one direction by the annular lip 48. When the cover component 14 is affixed to the base component 12, the cover plate 18 acts to preclude movement of the disc shaped media in the opposite perpendicular direction to the plane of the disc shaped media.

Figure 2A:
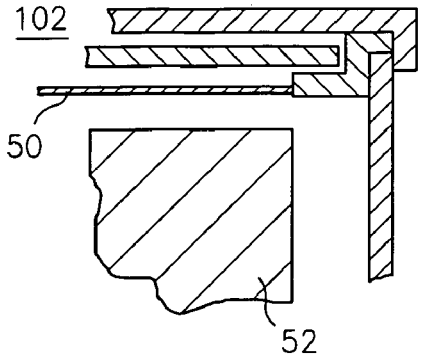
FIG. 2A is an alternative embodiment of the device shown in FIG. 2, wherein a protective element is inserted between the first and second chambers.

In the embodiment disclosed in FIG. 2A, a protective member 50 is attached to the annular lip 48. The protective member can be made of plastic film or any other conventional material to provide a barrier between the disc shaped media and other materials 52 which can be stored in the base component 12 of the packaging device 10. The protective member can be permanently affixed to the annular lip or it can be affixed at the time of assembly and shipment and removed by the consumer after purchase, i.e., at a time when further "rough handling" that would cause interaction between the disc shaped media and the other materials is less likely to occur.

Figure 2B:
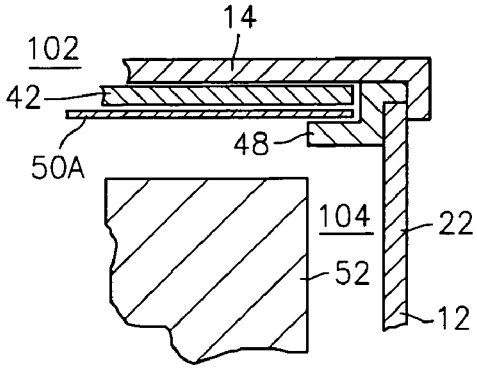
FIG. 2B is an alternative embodiment of the device shown in FIG. 2A, showing an alternative method of insertion of the protective element between the first and second chambers.

In an alternative embodiment disclosed in FIG. 2B, the protective element is removable and sized to seat on the annular lip 48 between the annular lip 48 and the disc shaped media. The protective element is round like the disc shaped media and has a central opening into which one's finger can be inserted to engage, lift and remove the protective element and subsequently engage, lift and replace the protective element.

Figure 2C:
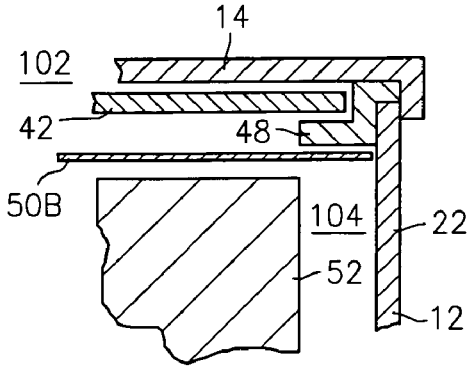
FIG. 2C is a further alternative embodiment of the device shown in FIG. 2A, showing, a further alternative method of insertion of the protective element between the first and second chambers.

In an alternative embodiment disclosed in FIG. 2C, the protective element 50B is flexible and is removably inserted within the lower base component beneath the annular lip 48 and on top of the other materials 52 placed therein. The protective element is sized to correspond to the interior wall 26 and has a central opening into which one's finger can be inserted to engage, lift and remove the protective element and subsequently engage, lift and replace the protective element. Alternatively, the protective element can be provided with a lift tab or some other conventional means whereby it can be grabbed and removed.

Figure 3:
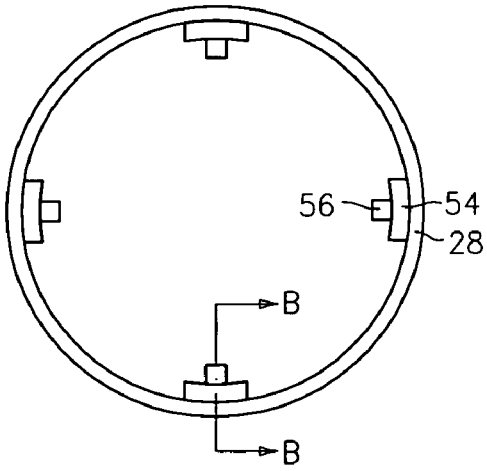
FIG. 3 is a top plan view of the novel disc packaging device of the present invention illustrating the alternative use of abutments and protrusions affixed to the inside wall of the container.
Figure 3A:
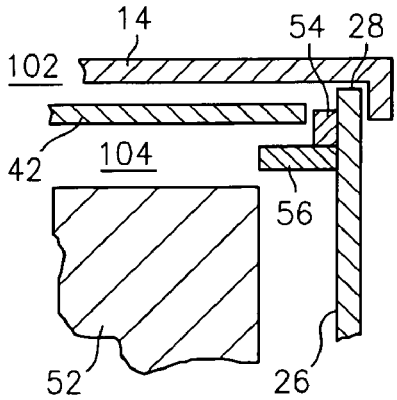
FIG. 3A is a cut-away, cross-sectional side view of a portion of the device shown in FIG. 3, along line B—B, with a disc-shaped media and other materials inserted and the lid affixed.

In the alternative embodiment shown in FIGS. 3 and 3A, the inner structure 40 is modified. The annular collar 44 with annular ring 46 and annular lip 48 is replaced by discrete abutments 54 and discrete protrusions 56. Collectively, the abutments 54 and protrusions 56 are positioned within the lower base component 12 around the circumference of the inner wall 26 spaced below the rim 28, affixed to the inner wall 26, so as to perform the same function as the annular ring 46 and annular lip 48. Specifically, the abutments 54 preclude movement of the disc shaped media in the plane of the disc shaped media i.e., performing the same function as the annular ring 46. Similarly, the protrusions 56 are positioned about the inner wall 26 and collectively preclude movement of the disc shaped media in a direction perpendicular to plane of the disc shaped media i.e., performing the same function as the annular lip 48.

Figure 3B:
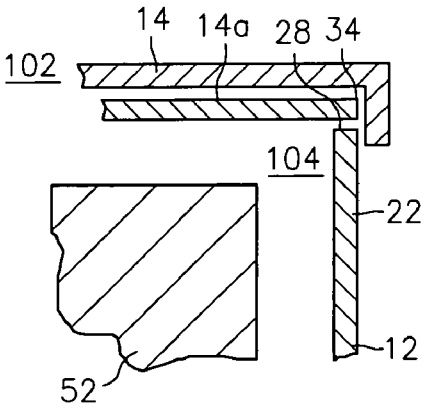
FIG. 3B is a cut-away, cross-sectional side view of an alternative embodiment of the novel disc packaging device of the present invention illustrating the alternative use of the upstanding rim of the base and the inside wall of the cover in place of the abutments and protrusions of FIG. 3.

FIG. 3B shows a further alternative embodiment wherein the disc shaped media is seated on the rim 28 and movement of the disc shaped media perpendicular to its plane is prevented in one direction by the rim 28. When the cover 14 is affixed to the base component 12, movement of the disc shaped media in the plane of the disc shaped media is precluded by the inner wall 34 of the cover 14 and inner surface 14*a* of the cover 14 acts to preclude movement of the disc shaped media in the second, opposite perpendicular direction to the plane of the disc shaped media.

Figure 3C:
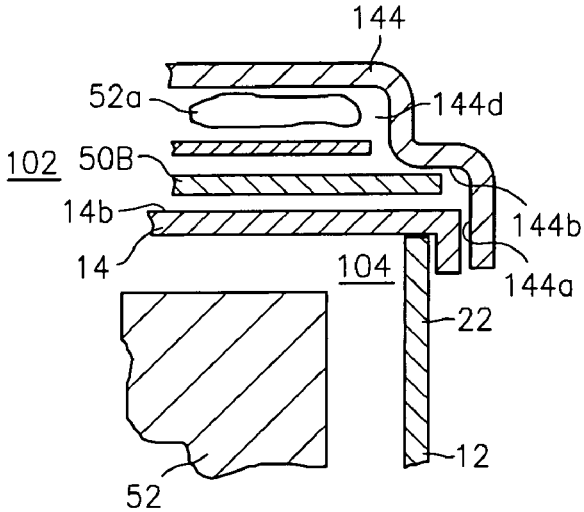
FIG. 3C is a cut-away, cross-sectional side view of an alternative embodiment of the novel disc packaging device of the present invention illustrating the alternative use of the outer surface of the cover and the inner surface of a supplementary cover in place of the abutments and protrusions of FIG. 3.

FIG. 3C shows a further alternative embodiment wherein the disc shaped media is seated on the outside surface 14*b* of the cover 14 and movement of the disc shaped media perpendicular to its plane is prevented in one direction by a supplementary cover 144 that snaps onto the cover 14. When the supplementary cover 144 is affixed to the cover 14, movement of the disc shaped media in the plane of the disc shaped media is precluded by the inner wall 144*a* of the supplementary cover 144 and the inner wall 144*b* of the supplementary cover 144 acts to preclude movement of the disc shaped media in the second, opposite perpendicular direction to the plane of the disc shaped media. The supplementary cover 144 can include a chamber 144*d* and a protective element 50*b* can be inserted to prevent contact between the disc shaped media and whatever materials 52*a* are placed in the chamber 144*d*.

Figure 4:
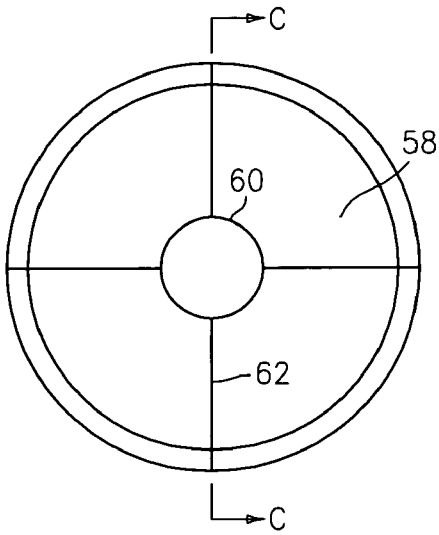
FIG. 4 is a top plan view of the novel disc packaging device of the present invention illustrating the alternative use of a center annular post support for the disc-shaped media suspended from spokes.
Figure 4A:
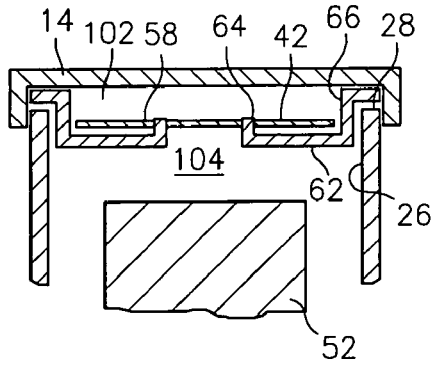
FIG. 4A is a cut-away, cross-sectional side view of the device shown in FIG. 4, along line C—C, with a disc-shaped media and other materials inserted and the lid affixed.

In the alternative embodiment seen in FIGS. 4 and 4A, the inner support structure 40 is replaced with an inner support structure 58 that provides center support for the disc shaped media as opposed to the circumferential support provided by inner structure 40. In the embodiment shown in FIGS. 4 and 4A, the alternative inner structure 58 includes an annular ring 60 and spokes 62 extending therefrom. As seen in FIG. 4A, the annular ring 60 has a raised portion 64 on which the disc-shaped media 42 sits, The spokes 62 each have a finger portion 66 which extends upwardly and outwardly such that when the structure 58 is inserted into the base component 12, the fingers 56 frictionally engage the inner wall 26 and sit on the upper rim 28. The structure 58 can include webbing between the fencers 56 (ala the webbing in a duck's foot) comprised of a thin material to provide protection for the disc shaped media 42 from the other materials 52. Inside the annular ring 60 would be left open to allow the consumer, after removing, the cover 14, to insert their finger into the annular ring and to thereby remove both the disc shaped media 42 and the structure 58.

Figure 5:
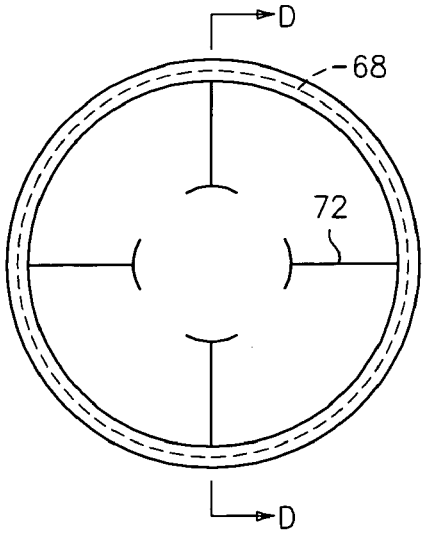
FIG. 5 is a top plan view of the novel disc packaging device of the present invention illustrating fingers that extend from a frame carried by the side wall of the container and that provide center support for the disc-shaped media.
Figure 5A:
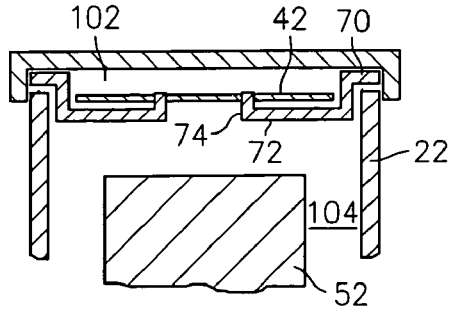
FIG. 5A is a cut-away, cross-sectional side view of the device shown in FIG. 5, alone, line D—D, with a disc-shaped media and other materials inserted and the lid affixed.

FIGS. 5 and 5A show a further alternative inner structure 68 comprising an annular collar 70 from which fingers 72 extend inwardly. At the ends of the fingers 72 are upstanding projections 74. The annular collar 70 nests inside the inner wall 26 and sits on the rim 28 in the same manner as the inner structure 40 in the embodiment shown in FIGS. 1 and 2. The upstanding projections 74 cooperate to provide a center support structure for the disc shaped media.

Figure 6A:
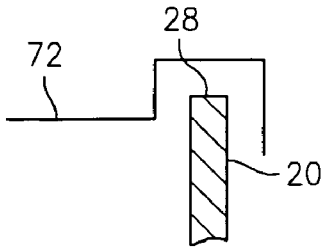
FIGS. 6A and 6B are cross-sectional views of alternate embodiments of the packaging device of the present invention depicting two different methods of mounting the disc-shaped media support member to the device outer wall.
Figure 6B:
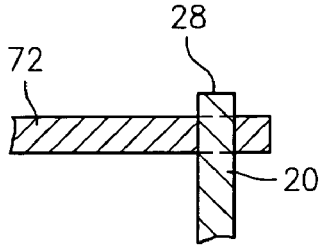

As seen in FIGS. 6A and 6B, the fingers 72 in the embodiment shown in FIGS. 5 and 5A do not necessarily need to be suspended from an annular collar. Alternatively, the could be clipped to the side wall 20 as seen in FIG. 6A or they could be screwed into the side wall 20 as shown in FIG. 6B.

Figure 7:
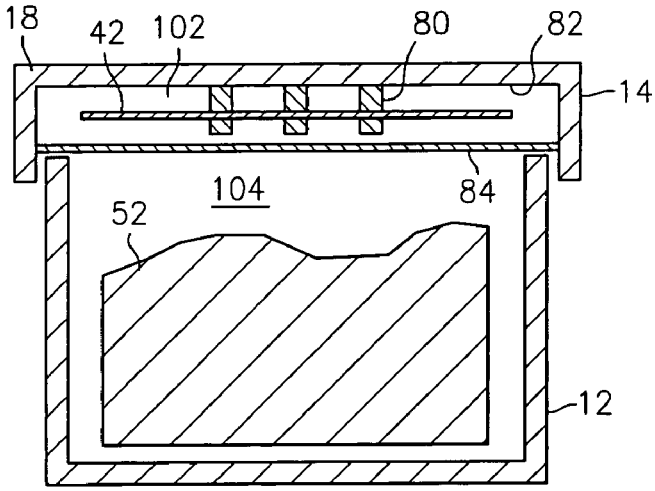
FIG. 7 is a cut-away, cross-sectional side view of an alternative embodiment of the present invention with disc-shaped media and other materials inserted, the protective element inserted and the lid closed, in which the first chamber in which the disc-shaped media is stored is in the cover.

In an alternative embodiment shown in FIG. 7, a center support structure is provided for the disc shaped media in the upper cover component 14. Specifically, projections 80 extend from the inside wall 82 of the end plate 18. These projections 80 cooperate to provide secure support for the disc shaped media in the cover component 14. A protective element 84 can be provided which is either removably nested within the cover as shown or which can be inserted at the time of manufacture and removed and discarded by the consumer after purchase. The cover 14 can engage the base component 12 in any variety Of conventional ways, e.g., snap on, telescope on, screw on, etc.

Figure 7A:
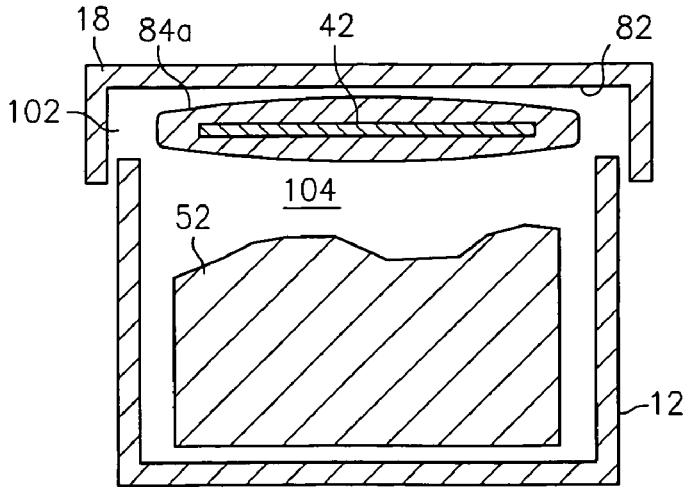
FIG. 7A is a cut-away, cross-sectional side view of an alternative embodiment of the device shown in FIG. 7, wherein the disc-shaped media is inserted into a protective envelope that is affixed to the inner surface of the cover.

In a further alternative embodiment shown in FIG. 7A, the disc shaped media is encased within an envelope 84*a* made of plastic or some other suitable material and which is affixed to the inside wall 82 of the end plate 18. The envelope is either removably or permanently affixed, e.g., by gluing, with double-sided tape, or by other conventional means. The envelope can itself constitute a re-useable packaging container for the disc shaped media that either remains affixed to the plate 18 or can be removed from the plate 18, e.g., so that the cover 14 can be discarded. Or the disc shaped media can be packaged within a packaging sleeve (not shown) ail of which can then be inserted into the envelope and then removed from the envelope once the envelope is opened.

Figure 8:
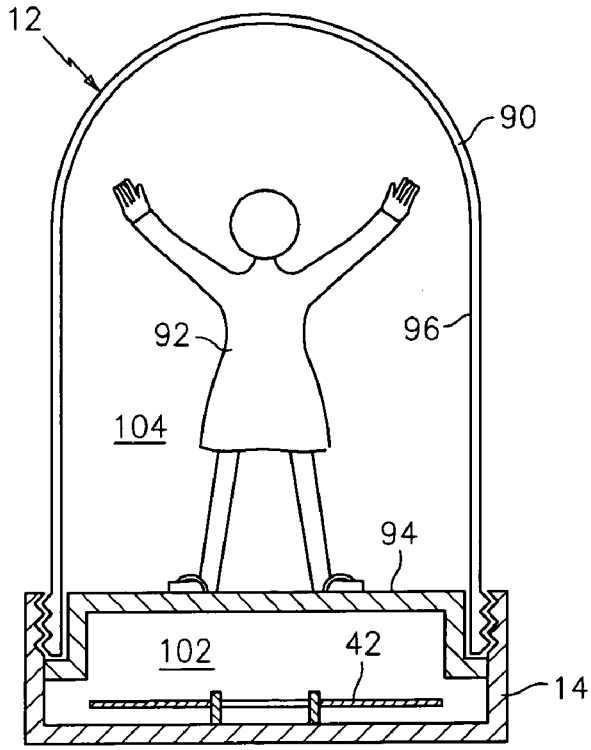
FIGS. 8 and 8A are side perspective, partially cut-away, cross-sectional views of alternative embodiments of the present invention, illustrating the use of the "lid" of the embodiment shown in FIG. 7 as the base, thereby allowing the portion of the invention defining the second chamber to be of an irregular shape (FIG. 8) or to have deformable construction (FIG. 8A)
Figure 8A:
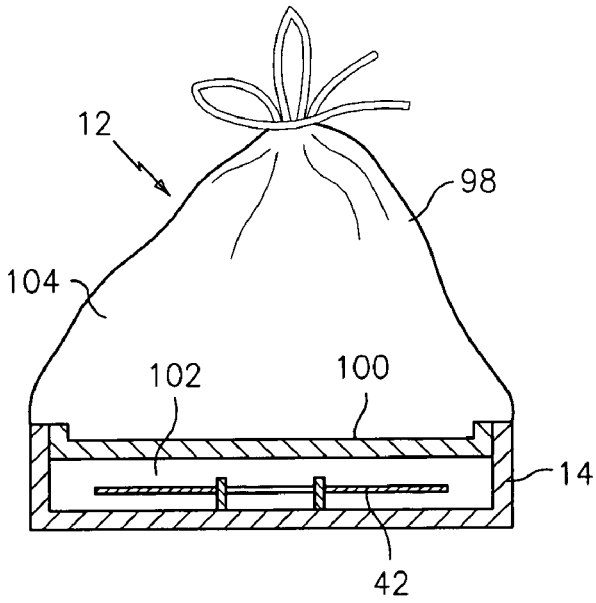

FIGS. 8 and 8A show further alternative embodiments of the present invention. In FIG. 8, the fact that the disc shaped media is stored within the cover component 14 allows for an alternative construction of the container 12. In this alternative embodiment, the cover 14 serves as the "base". The alternative base 90, in which the other materials, in this case, a doll 92, are stored, has an end wall structure 94 which frictionally encases the inner wall 96 and seals the chamber in the base 90. Alternatively, wall 94 can be provided with threads so that it will threadably engage corresponding threads on the inside wall 96. The cover 14 and base 90 can be attached in the same manner as heretofore been discussed in connection with other embodiments.

In the embodiment showing in FIG. 8A, the cover 14 once again carries the disc shaped media 42 and thereby allows the base 12 to be of a deformable construction 98. The deformable member 98 has a rigid internal support structure 100 which is designed to frictionally or threadably engage the cover 14.

Figure 9:
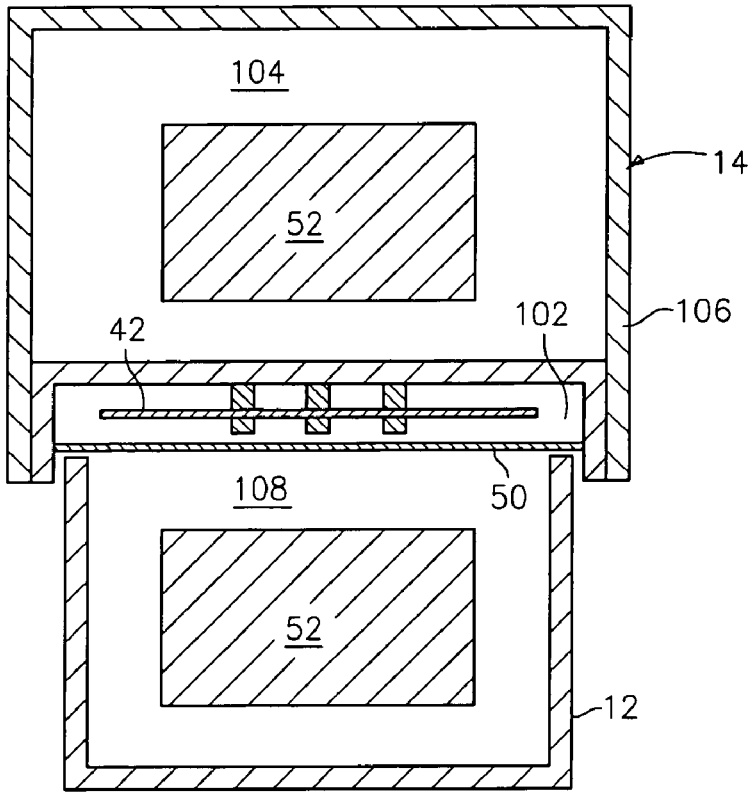
FIG. 9 is a cut-away, cross-sectional side view of an alternative embodiment of the present invention in which the disk media is located in the lid and the lid and the container include second and third chambers, respectively, for storing other material.
Figure 10:
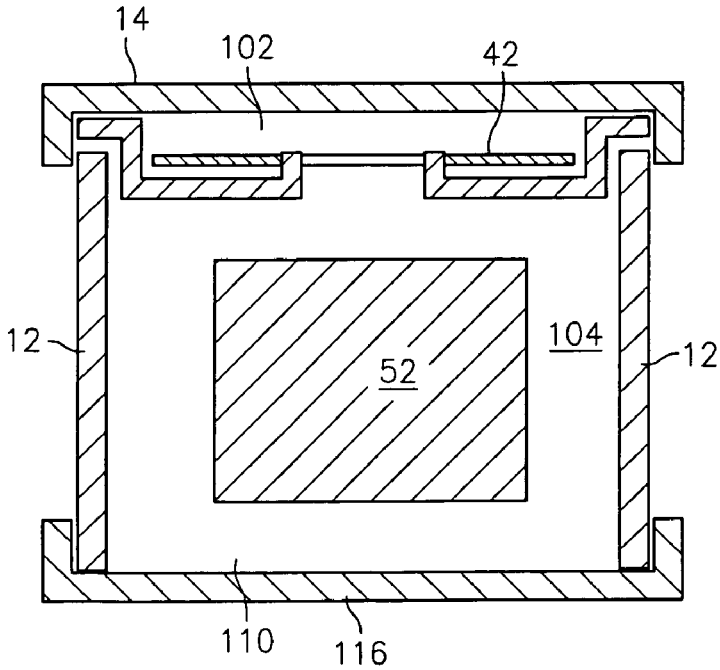
FIG. 10 is a cut-away, cross-sectional view of another embodiment of the present invention in which the second chamber in the container for storing other materials includes a second opening separate and distinct from the lid and a removable cover such that access to the second chamber can be attained without removing the lid.

In the alternate embodiment shown In FIG. 9, the disc shaped media is stored in a first chamber 102 in the lid 14 defined by an annular support 40 similar in construction to the embodiment of FIG. 7, except that the lid includes a second chamber 104 defined by an outer wall 106 for other materials and the base 12 includes a third chamber 108. In the alternate embodiment shown in FIG. 10, which is similar in construction to the embodiment of FIG. 4, there is provided an additional opening 110 in the container 22 and a cover 116 for closing the opening 110. The cover 116 can be removed to gain access to the chamber 104 without removing the cover 14.

Figure 11:
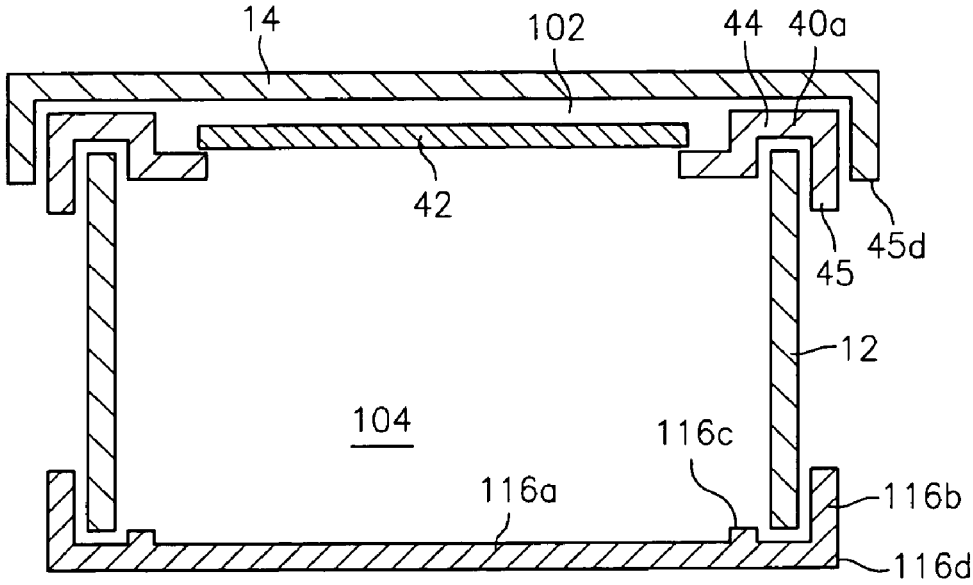
FIGS. 11 and 11A are cut-away, cross-sectional side views of another embodiment of the device shown in FIG. 10 in which the method of mounting shown in FIG. 6A is utilized and wherein the removable cover for the second chamber can be mated with the removable cover for the first chamber to form a mini-packaging device shown in FIG. 11A.
Figure 11A:
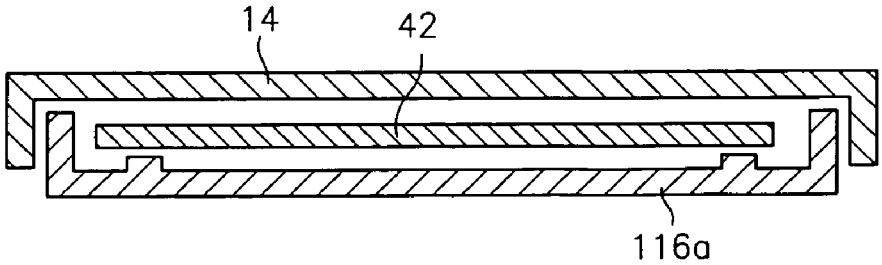

In the alternative embodiment shown in FIGS. 11 and 11A, an inner structure 40*a* is provided that is a slightly modified version of the inner structure 40 shown in FIG. 2, in that it includes an annular wall 45 that extends around the entire circumference of the annular collar 44 and engages the outer surface of the wall of the base 12, and the cover 14 is configured to engage not the base 12, but rather, the annular wall 45. An additional opening 110 is provided as in the embodiment of FIG. 10, and a cover 116*a* is provided that is a slightly modified version of the cover 116 of FIG. 10, in that it includes not only an outer annular wall 116*b* for engaging the outer surface of the wall of the base 12, but also an inner annular wall 116*c* for engaging the inner surface of the wall of the base 12. The circumferential dimension of the outer surface 116*d* of the wall 116*b* of the cover 116*a* is identical to the circumferential dimension of the outer surface 45*d* of the wall 45, such that the covers 14 and 116*a* can be removed and the cover 14 which matingly engaged the wall 45 will matingly engage the outer wall 116*b* of the cover 116*a*, as shown in FIG. 11A. In this way, as also shown in FIG. 11A, the covers 14 and 116*a* can be used together as a mini-packaging device for the disc shaped media 42. In the embodiment shown, the inner wall 116*c* helps to securely retain the disc shaped media against movement. However, it is understood that the benefits of the invention could be achieved without such inner wall, or utilizing one of the other retaining methods disclosed herein.

Figure 12:
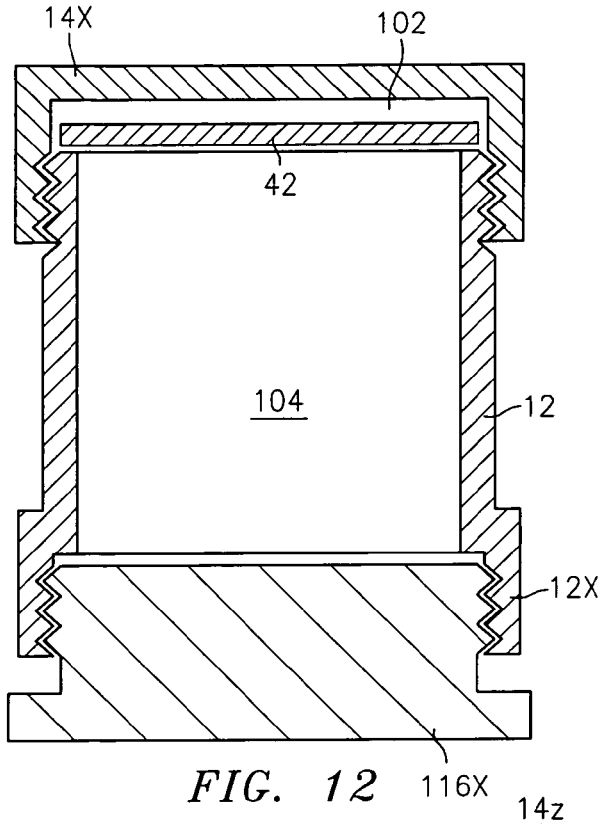
FIG. 12 is a cut-away, cross-sectional side view of an alternative embodiment of the device shown in FIGS. 11 and 11A in which the method shown in FIG. 3B for retaining the disc-shaped media is utilized and in which the two covers threadably engage the base and, when removed, can be threaded together to create a mini-packaging unit.

In the alternative embodiment shown in FIG. 12, the disc shaped media seats on the rim 28 as in the embodiment shown in FIG. 3B, but the cover 14*x* does not snap onto the base 12, but rather, threadably engages it. Furthermore, the bottom 12*x* of the base 12 is flared outwardly and contains internal threads that are of the same dimension as the internal threads of the cover 14*x*. The cover 116*x* includes mating external threads such that the cover 116*x* can be threaded into the flared bottom 12*x* of base 12. In this way, the covers 14*x* and 116*x* can be removed from the base 12 and threadably engaged to form a mini-packaging unit for the disc shaped media.

Figure 12A:
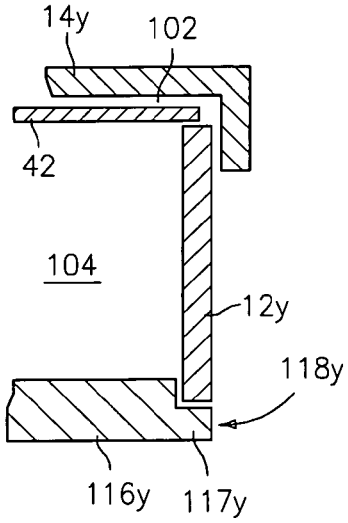
FIGS. 12A and 12B are cut-away, cross-sectional side views of alternative embodiments of the device shown in FIG. 12, wherein the two covers slidably engage after removal (FIG. 12A) or threadably engage after removal (FIG. 12B)
Figure 12B:
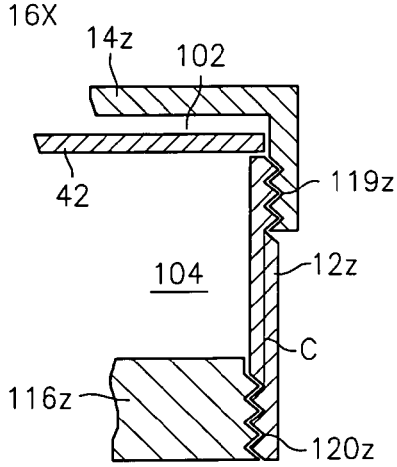

In the alternative embodiments of FIGS. 12A and 12B, the need to flare out the bottom of the base 12 is eliminated. In FIG. 12A, the base 12*y* receives a bottom cover 116*y* that includes an overlapping portion 117*y*, the outer surface 118*y* of which is of equal dimension to the outer surface 118*y* of which is of equal dimension to the outer wall of the base 12*y*, such that covers 14*y* and 11*y* can be slidably engaged to form a mini-storage unit for the disc-shaped media. In FIG. 12B, the base 12*z* has an external threaded portion 119*z* and an internal threaded portion 120*z* each of which extends beyond the center line "C" of the wall of the base 12*z*. In this way, when the covers 14*z* and 116*z* are removed, they can be threadably engaged to form a mini-storage unit for the disc-shaped media.

Figure 13:
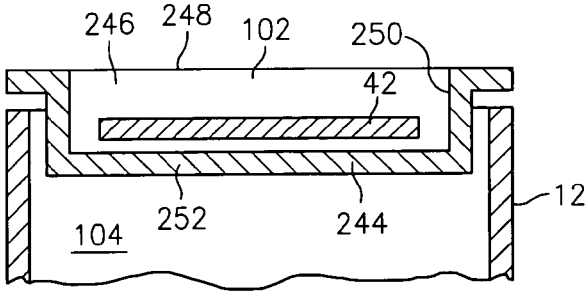
FIG. 13 is a cut-away, cross-sectional side view of another embodiment of the present invention in which a concave cavity on the exterior side of the cover for the device forms the first chamber for the disc-shaped media and a seal encloses the disc-shaped media within the concave cavity.

FIG. 13 shows a further alternative embodiment, wherein the cover 244 nestingly seats within the base 12 and the disc shaped media 42 is placed within the concave recess 246 of the cover 244. A seal 248 made of plastic or other suitable material is applied to the cover 244 to hold the disc shaped media within the cover 244 until the seal is removed by the user. The disc shaped media can be retained against movement within the cover 244 as a result of contact with the side walls 250, bottom wall 252 and seal 248, or by utilization of any of the other methods taught herein.

Figure 14:
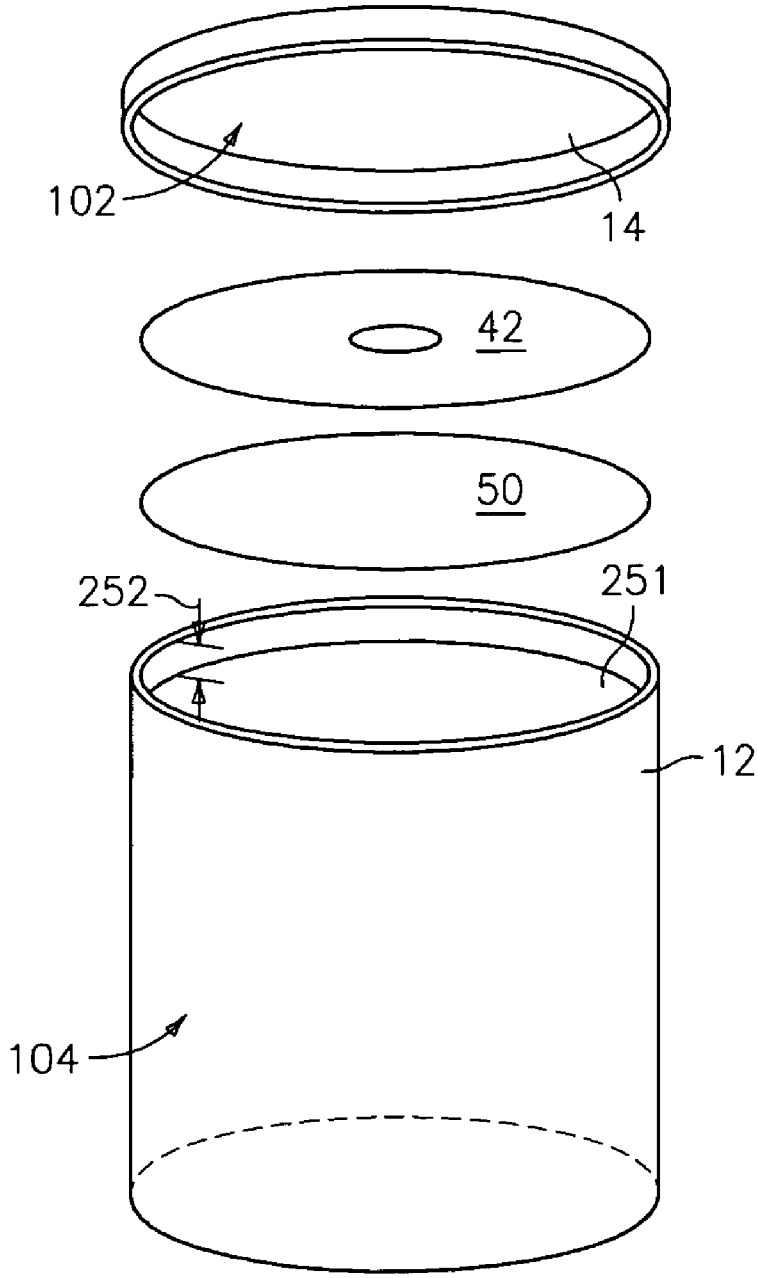
FIG. 14 is an exploded perspective view of a further alternative embodiment of the novel disc packaging device of the present invention with the lid, disk media and protective element removed, illustrating the use of a sealed base.

FIG. 14 shows a further alternative embodiment wherein the base 12 is a separately manufactured container of miscellaneous content, that includes a slightly concave end 251, the depth 252 of which exceeds the combined thickness of a disc shaped media 42 and a protective element 50 which are seated within the concave end 251 and held there by cover 14 which snaps onto base 12. In an alternate embodiment, a protective element is not used or the disc shaped media is packaged in an envelope (not shown).

Figure 15:
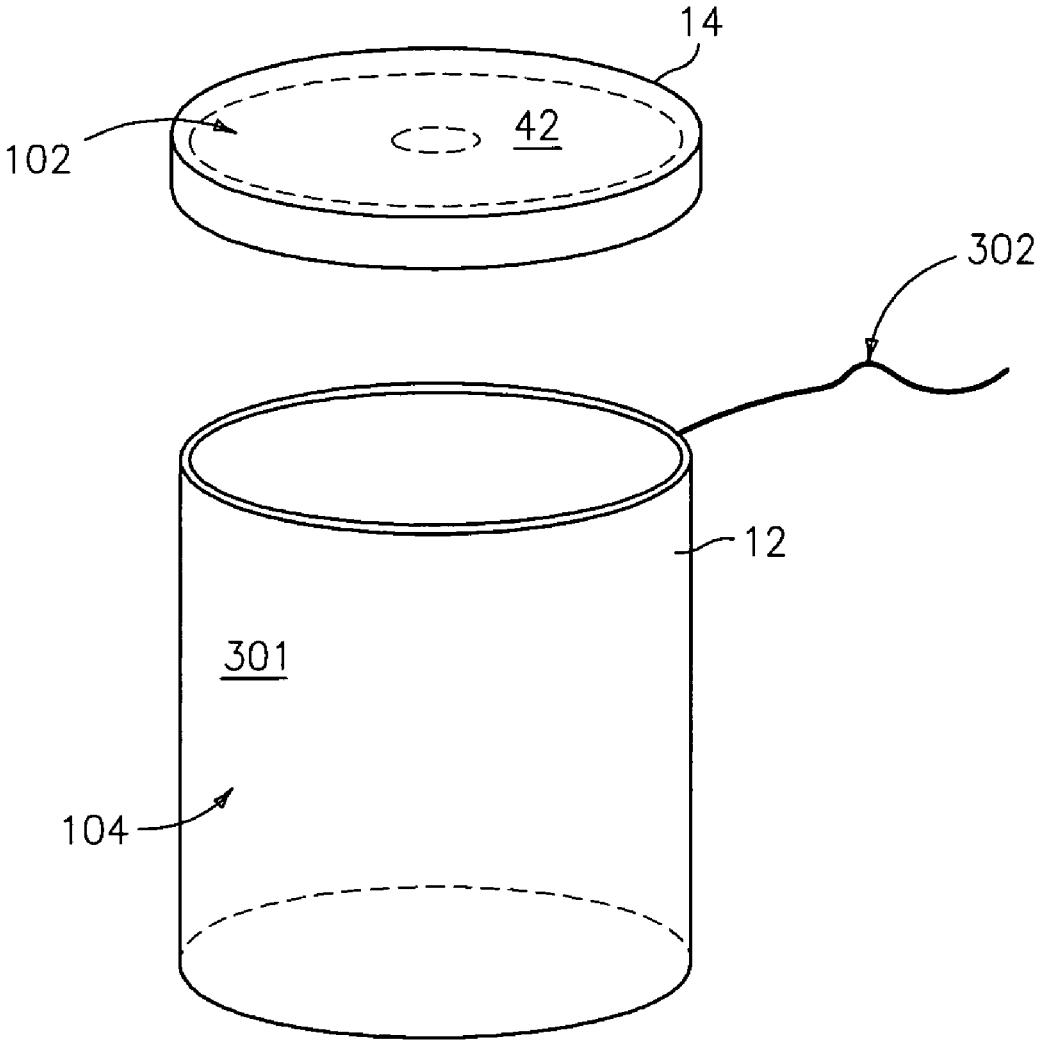
FIG. 15 is an exploded perspective view of a further alternative embodiment of the novel disc packaging device of the present invention in which the disk media is sealed within the lid, and the base is separately sealed, and the lid and base are detachably joined together by an outer packaging skin that can be severed with a pull string.

FIG. 15 shows a further alternative embodiment wherein the disc shaped media is mounted and sealed within cover 14, e.g., as taught herein in connection with other embodiments, and cover 14 is attached to base 12 by paper packaging material skin 01 that binds the cover 14 and base 12 together. Cover 14 is separated from base 12 by pulling string 302 which tears the skin 301 and breaks the circumferential attachment between cover 14 and base 12.

It would be understood that in each embodiment, a container device is provided in which disc shaped media can be packaged, distributed, displayed at retail and, if desired, restored with other materials and that, in effecting such usage, discrete chambers are provided for the disc-shaped media and for the other materials so as to prevent contact between the disc-shaped media and the other materials. In the embodiments shown in FIGS. 1 through 6B, the inner structure, whether it is the annular collar of FIG. 1, or the discretely positioned abutment/protrusion clips of FIG. 3, or the upstanding rim in FIG. 3B, or the lid and supplemental lid of FIG. 3C, or the "spider" structure of FIG. 4, or the "trap" structure of FIG. 5, in each case is located in and helps define a first chamber in the lower base component 12. Underneath this first chamber is a second chamber. The first chamber receives and securely holds, despite repeated removal and re-packaging, the disc shaped media. The second chamber receives the other materials and keeps these materials separate from the disc shaped media. The need for a separate "jewel case" for the disc shaped media is thus completely eliminated.

It would be understood that the shape of the container can be varied without departing from the scope of the present invention, e.g., the cylindrical base 12 can be square or rectangular so long as the outer wall of the collar 40 corresponds and the collar includes spacers from the outer wall of the collar to the annular ring and annular lip of the present invention. Similar adjustments could be made to the other embodiments as would be apparent to those skilled in the an having reviewed this disclosure. The abutment/protrusions clips of FIG. 3 could be mounted on a non-cylindrical shaped base, as could the spider structure of FIG. 4 or the trap structure of FIG. 5.

It would be understood by those skilled in the art that the function of the annular ring of FIG. 1 or the abutments of FIG. 2 could be performed by an appropriately dimensioned inner wall 26 of the container 12.

It would be further understood that while several methods of attaching the annular collar of FIG. 1, the abutment/protrusion clips of FIG. 2, the spider structure of FIG. 3 and the trap structure of FIG. 4 have been shown, those skilled in the alt after having reviewed this disclosure could devise other means of attachment without departing from the scope of the present invention.

It would be further understood by those skilled in the art that the device and method of this invention can accommodate one or more disc shaped media, e.g., through the insertion of protective elements therebetween.

Illustrated in FIGS. 16–21 are additional embodiments of the present invention comprising a first member or member 500 adapted to receive the disc-shaped media 42, and thereafter to be affixed to the cover or top 502 of a container or containers 503, which container or containers may be of any size or shape, regardless of whether smaller or larger in area than the member 500. In the embodiments shown in FIGS. 16–21, provided at the center of the member 500 is a cylindrical projection 504 which serves the purpose of maintaining the disc shaped media 42 in a stable state within the cavity 506 formed by the member 500, by receiving and retaining the disc-shaped media 42 such that the disc-shaped media 42 is prevented from moving linearly parallel to the plane of the disc-shaped media 42, while allowing the disc-shaped media 42 to rotate around the cylindrical projection 504. Toward that end, the outer diameter of the cylindrical projection 504 must be slightly less than the diameter of the annular aperture in the disc-shaped media 42 such that the cylindrical projection 504 may be in frictional contact with or loosely contact the annular aperture in the disc-shaped media 42. It would be understood that the other means of maintaining the disc media in stable state taught herein, e.g., by means of members engaging the outer edge of the disc media, may alternatively be employed without departing from the scope of the present invention.

The disc-shaped media 42 is further protected within the member 500 by means of raised shoulder or edge element 508 encircling the perimeter the member 500, which shoulder or edge element 508 serves the dual purpose of forming the outer wall of the cavity 506 and protecting the disc-shaped media 42 from damage to the edges of the media 42 caused by contact with external forces being applied to the member 500. In the preferred embodiment, the shoulder or edge element 508 is composed of a stiff material having some flexibility such as plastic such that it can deform so as to absorb and redistribute any force applied thereto. A downwardly extending extension 510 may also be provided, which extension 510 serves to increase the surface area of the shoulder or edge element 508 to thereby supplement the protection to the disc-shaped media 42. The height of shoulder or edge element 508 should be sufficient that it is at least coplanar with the upper surface of the disc-shaped media 42, although it is preferable if its upper surface is above the upper surface of the disc-shaped 42.

A separate annular downwardly extending skirt member 512 is provided to attach the member 500 to the cover or top 502 of the container or containers 503. In the preferred embodiment, the skirt member 512 is also composed of a stiff material having some flexibility so that it can deform to match the contours of the cover or top 502. This deformation also serves to help retain the member 500 in place on the cover or top 502 by allowing the skirt member 512 to "grip" the cover or top 502. It should therefore be appreciated that the inner dimensions of the skirt member 512 should be slightly smaller than the external dimensions of the cover or top 502 so that the member 500 may be secured to the top of the container 503 by means of the compression fit between the skirt member 512 and cover or top 502.

Figure 17:
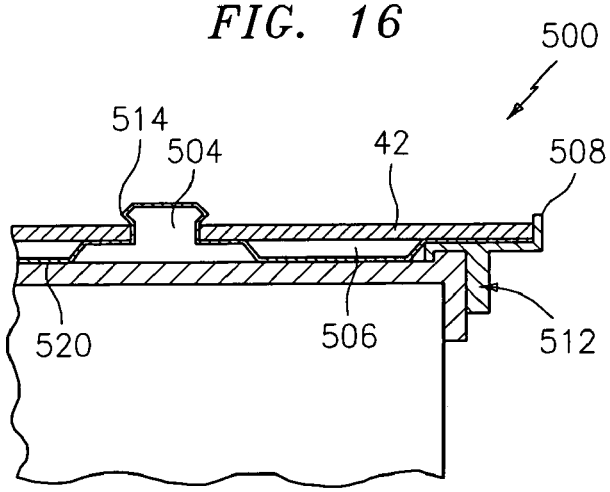
FIG. 17 is a cut-away, cross-sectional view of a further alternative embodiment of the novel disc packaging device of the present invention in which in which the packaging device is larger than the cover to the container to which it is attached and is attached to the container by means of engagement to the inside rim of the container.

In an alternative embodiment illustrated in FIG. 17, the skirt member 512 may also engage the cover or top 502 about an inner perimeter of the cover or top 502. In such embodiment, the external dimension of the skirt member 512 should be slightly larger than the internal dimension of the inner perimeter of the cover or top 502 such that the deformation of the skirt member 512 serves to provide an outwardly directed force that increases the frictional contact between the skirt member 512 and inner perimeter of the cover or top 502.

Additional structures may also be included within the member 500 to ensure the stability and integrity of the disc-shaped media 42. For example, as seen in FIG. 17, one or more outwardly extending protrusions 514 may be provided at the top of the cylindrical projection 504, which protrusions 514 serve to prevent the disc-shaped media 42 from sliding off the cylindrical projection 504. The protrusions 514 and the cylindrical projection 504 in such embodiment should be at least slightly flexible so as to allow the disc-shaped media 42 to be "snapped over" the protrusions 514 in order to repeatedly attach and remove the disc-shaped media 42 from the cylindrical projection 504.

Figure 16:
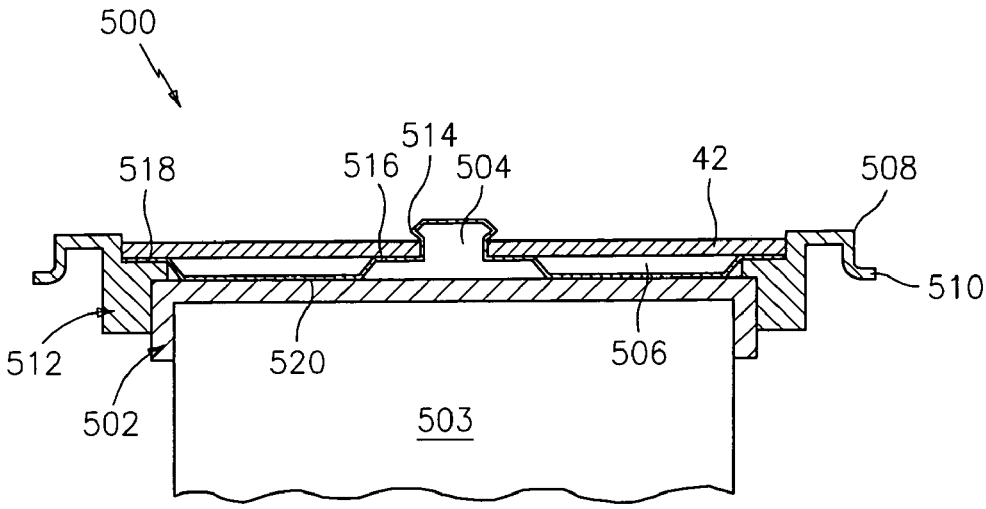
FIG. 16 is a cut-away, cross-sectional view of a further alternative embodiment of the novel disc packaging device of the present invention in which in which the packaging device is larger than the cover to the container to which it is attached and fits about the cover or lid to said container.

Inner and outer raised shelves 516, 518 as seen in FIG. 16 may also be provided in the member 500 so as to raise the disc-shaped media 42 above the floor 520 of the member 500, so as to prevent damage to the media surface of the disc-shaped media 42. The inner raised shelf 516 may be disposed about the cylindrical projection 504 so that it does not come into contact with the media surface. The outer raised shelf 518, however, may or may not come into contact with the media surface. Accordingly, if necessary, such shelf 518 should be composed of or covered by a material that will not damage the media surface.

Figure 18:
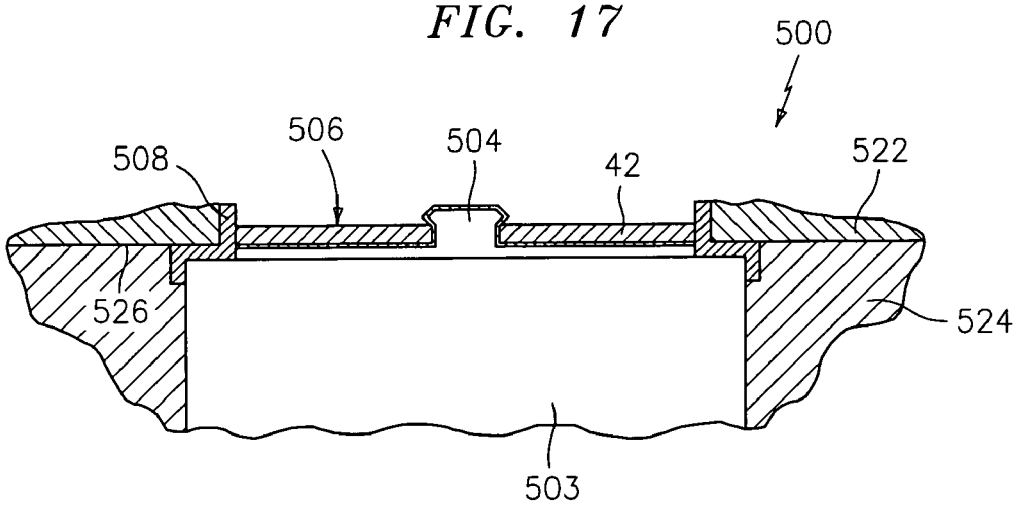
FIG. 18 is a cut-away, cross-sectional view of a further alternative embodiment of the novel disc packaging device of the present invention in the which the packaging device is formed from a two part injection mold wherein the dimension and size of the upper portion remain constant while the dimension and size of the lower portion may be varied so as to conform to the dimensions of the container to which the packaging device is to be attached.

FIG. 18 illustrates an alternative embodiment of the present invention in which the member 500 is formed by injection molding using a mold that has two halves—an upper mold 522 and a lower mold 524, which molds 522, 524 are joined at centerline 526. It should be appreciated that the dimensions and structures formed by the upper mold 522 can be made constant, inasmuch as the dimensions of the disc-shaped media 42 never change, and therefore the raised shoulder or edge element 508 and cylindrical projection 504 do not need to change. The lower mold 524, however, can be varied depending upon the shape and size of the container or container 503 to which the member 500 is to be attached. This embodiment eliminates the need for manufacturing numerous different molds so as to accommodate discs 42 and containers 503 of varying sizes. A manufacturer need only identify the size of the disc-shaped media 42 and the size and shape of the container or containers 503, and match the two molds 522 and 524 appropriate for each together.

Figure 19:
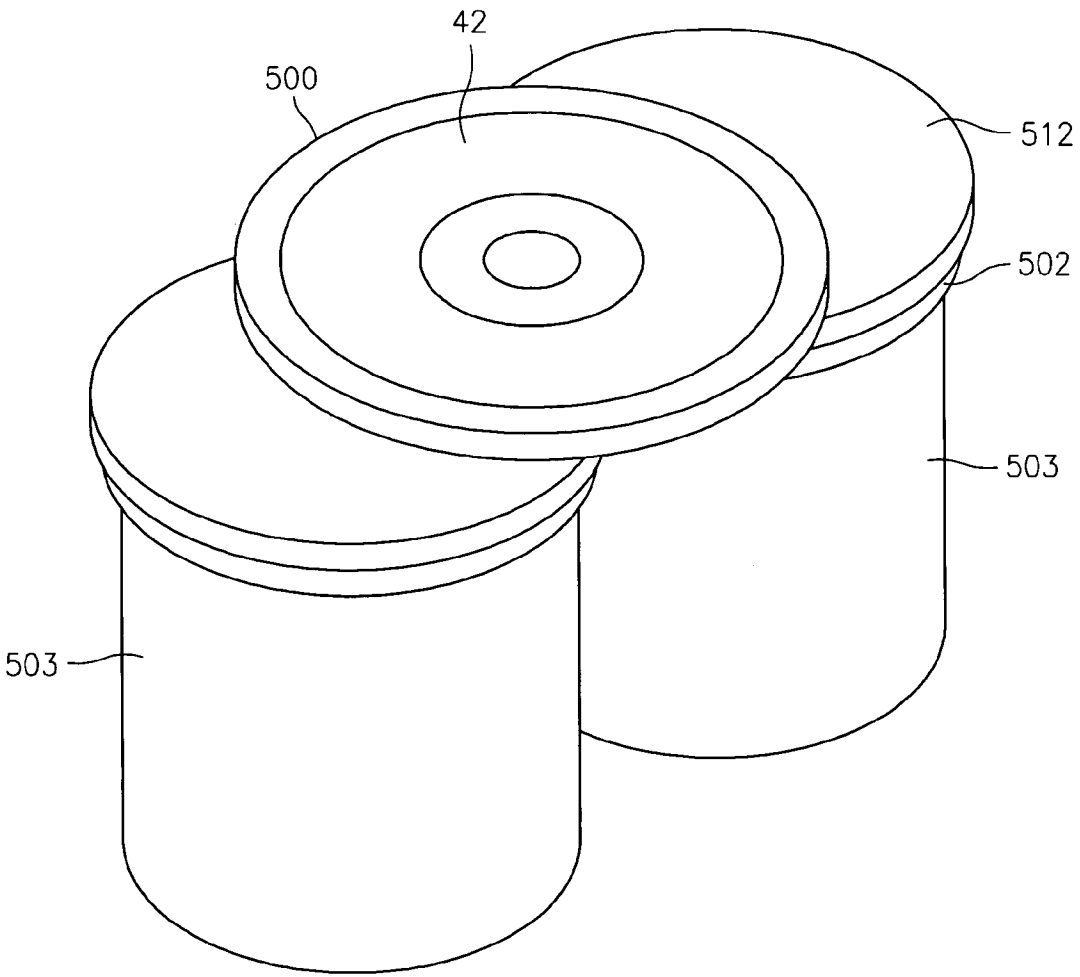
FIG. 19 is a perspective view of a further alternative embodiment of the novel disc packaging device of the present invention in which the packaging device is attached to two or more containers.
Figure 20:
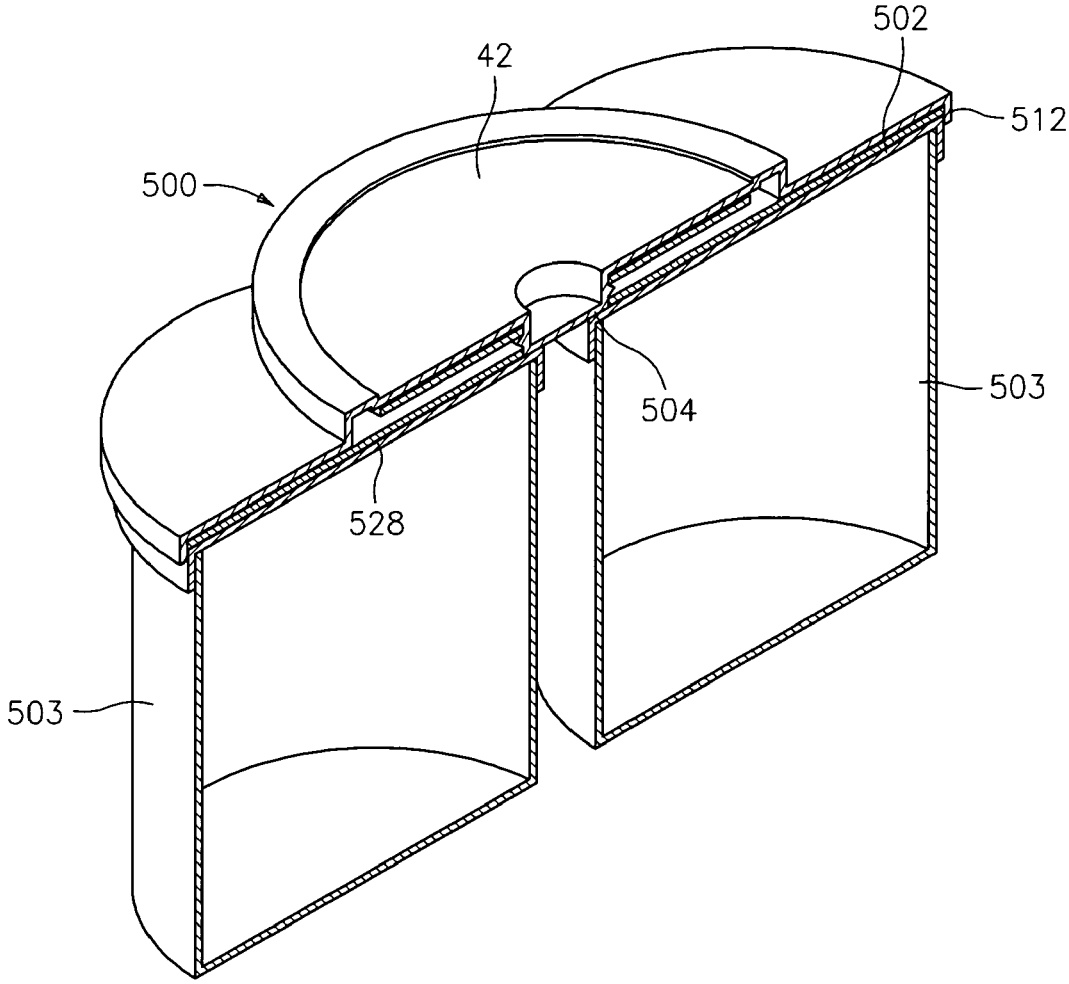
FIG. 20 is a cut-away, cross-sectional view of the embodiment of FIG. 19 in which the disc-shaped media is stored on the bottom of the packaging device, facing the containers to which it is attached.
Figure 21:
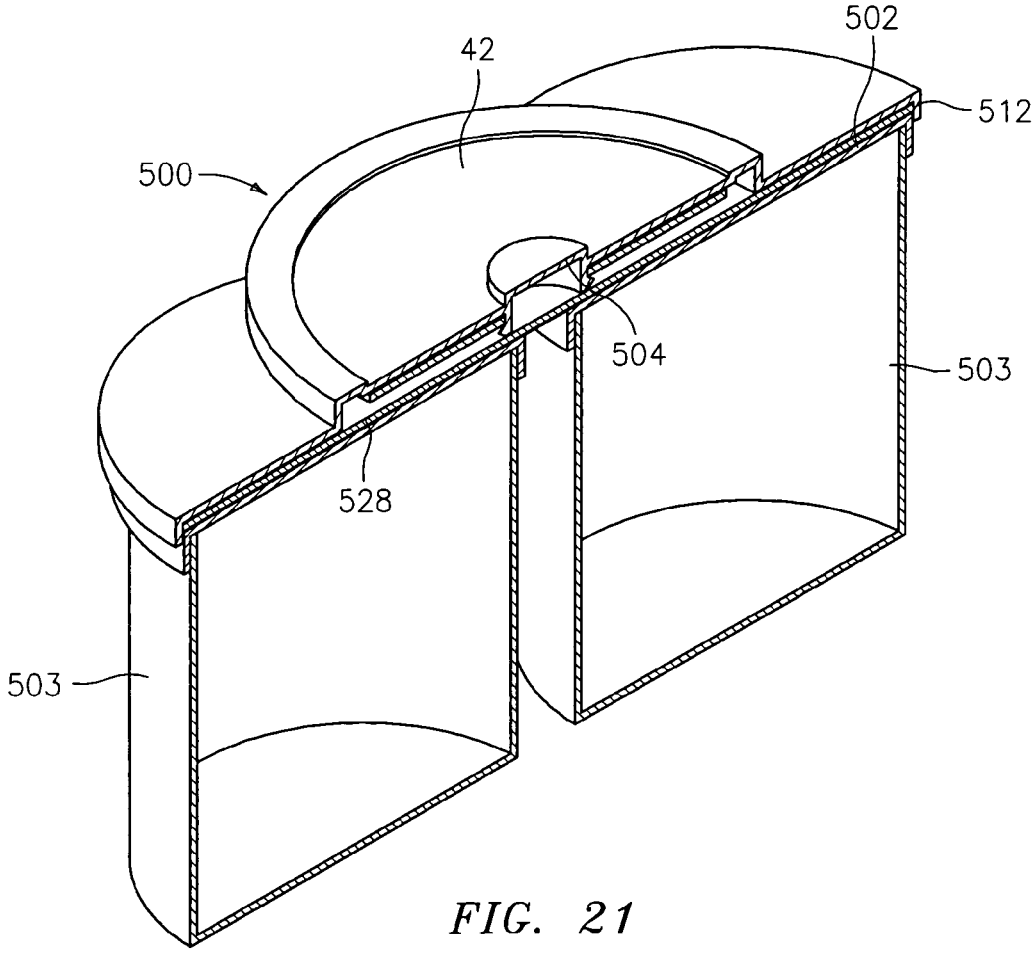
FIG. 21 is a cut-away, cross-sectional view of the embodiment of FIG. 19 in which the disc-shaped media is stored on the top of the packaging device, separated from the containers to which it is attached.

Illustrated in FIGS. 19 through 21 is the attachment of the member 500 to two or more containers simultaneously. In such embodiments, the skirt member 512 is sized so as to conform to the shape of the covers or tops 502 of the containers 503. This embodiment has particular applicability for tube-shaped containers 503 such as tennis ball containers or containers for potato chips, for example. The advantage of such embodiment is that it allows for the positive juxtaposition of products, as well as allowing the products to be packaged in an alternating arrangement (e.g., "head" to "toe") in shipping cartons, which saves packaging space. Furthermore, it should be appreciated that while the figures show the member 500 being attached to two containers 503, any number of containers 503 may be covered/attached by this embodiment.

Furthermore, it should be appreciated that the disc-shaped media 42 may be situated in the cavity 506 created in the member 500 in several configurations, including the inwardly facing configuration shown in FIG. 20 as well as the outwardly facing configuration shown in FIG. 21. In the former, a separate protective element or seal 528 may be provided so as to prevent contact between the disc-shaped media 42 and the containers 503. In the latter configuration, a cover 530 or lid may be provided to cover the member 500 and further serve to retain the disc-shaped media 42 within the cavity 506. Of course, the protective element 528 or cover 530 may be used in any of the other embodiments already described.

Having thus described the invention with particular reference to the preferred forms thereof, it will be obvious that various changes and modifications can be made therein without departing from the spirit and scope of the present invention as defined by the appended claims.

Wherefore we claim:

1. A packaging device for packaging a media disk together with at least one container for storage of materials other than said media disk, said at least one container having a top cover, wherein said media disk is larger in diameter than at least one dimension of said top cover, said packaging device comprising:

a disc-shaped media having a central hole therein and an outer edge;

a disc storage device including a cavity having an opening therein for receiving said disc-shaped media, said disc storage device including means for retaining said disc-shaped media against lineal movement within said cavity while simultaneously allowing said disc-shaped media to rotate; and means for attaching said disc storage device to said at least one container about said top cover.

2. The device of claim 1, wherein said cavity is bounded at one end by a surface, and wherein said retaining means comprises a support structure extending from said surface, wherein said support structure includes means adapted to be inserted through said hole so as to support and positively receive and retain said disc-shaped media.

3. The device of claim 2, wherein said disc storage device further includes a raised shoulder running around the perimeter of said surface, said shoulder serving to define said cavity and further serving to provide edge protection for said disc-shaped media.

4. The device of claim 3, wherein said shoulder further includes a downwardly extending extension, said extension further serving to provide edge protection for said disc-shaped media.

5. The device of claim 4, wherein said disc storage device further includes a downwardly extending skirt member, said skirt member being adapted to fit to the contours of said top cover, wherein said disc storage device may be secured within said top cover by means of engagement between said skirt member and said top cover.

6. The device of claim 5, wherein said skirt member is sufficiently flexible so as to deform to the contours of said top cover, and further wherein said disc storage device is secured within said top cover by means of the frictional engagement between said skirt member and said top cover.

7. The device of claim 3, wherein said disc storage device further includes a downwardly extending skirt member disposed adjacent to said raised shoulder, said skirt member being adapted to fit to the contours of said top cover, wherein said disc storage device may be secured about said top cover by means of engagement between said skirt member and said top cover.

8. The device of claim 7, wherein said skirt member is sufficiently flexible so as to deform to the contours of said top cover, and further wherein said disc storage device is secured about said top cover by means of the frictional engagement between said skirt member and said top cover.

9. The device of claim 2, wherein disc storage device further includes an internal raised annular ring disposed about said support structure on said surface, said internal raised annular ring adapted to support said disc-shaped media above said surface.

10. The device of claim 2, wherein disc storage device further includes an external raised annular ring disposed about the periphery of said surface, said internal raised annular ring adapted to support said disc-shaped media above said surface.

11. The device of claim 2, wherein disc storage device further includes an internal raised annular ring disposed about said support structure on said surface and an external raised annular ring disposed about the periphery of said surface, said raised annular rings adapted to support said disc-shaped media above said floor.

12. The device of claim 11, wherein said disc storage device further includes a raised shoulder running around the perimeter of said surface, said shoulder serving to define said cavity and further serving to provide edge protection for said disc-shaped media.

13. The device of claim 12, further including a cover for said disc storage device.

14. The device of claim 12, further including a protective element adapted to prevent damage to said disc-shaped media.

15. The device of claim 2, wherein said insertion means comprises a cylindrical projection extending from said surface.

16. The device of claim 14, wherein said insertion means further comprises at least one protrusion mounted on said cylindrical projection and wherein said projection and said protrusion are slightly flexible so as to allow said disc-shaped media to be snapped over said projection and said protrusion.

17. The device of claim 16, further including a cover for said disc storage device.

18. The device of claim 16, further including a protective element adapted to prevent damage to said disc-shaped media.

19. The device of claim 1, further including a cover for said disc storage device.

20. The device of claim 1, further including a protective element adapted to prevent damage to said disc-shaped media.

21. The device of claim 1, wherein said retaining means comprises edge element means to engage said outer edge of said disc-shaped media.

22. The device of claim 21, wherein said disc storage device further includes a raised shoulder running around the perimeter of said surface, said shoulder serving to define said cavity and further serving to provide edge protection for said disc-shaped media.

23. The device of claim 22, wherein said shoulder further includes a downwardly extending extension, said extension further serving to provide edge protection for said disc-shaped media.

24. The device of claim 23, wherein said disc storage device further includes a downwardly extending skirt member, said skirt member being adapted to fit to the contours of said top cover, wherein said disc storage device may be secured within said top cover by means of engagement between said skirt member and said top cover.

25. The device of claim 24, wherein said skirt member is sufficiently flexible so as to deform to the contours of said top cover, and further wherein said disc storage device is secured within said top cover by means of the frictional engagement between said skirt member and said top cover.

26. The device of claim 22, wherein said disc storage device further includes a downwardly extending skirt member disposed adjacent to said raised shoulder, said skirt member being adapted to fit to the contours of said top cover, wherein said disc storage device may be secured about said top cover by means of engagement between said skirt member and said top cover.

27. The device of claim 26, wherein said skirt member is sufficiently flexible so as to deform to the contours of said top cover, and further wherein said disc storage device is secured about said top cover by means of the frictional engagement between said skirt member and said top cover.

28. The device of claim 21, wherein disc storage device further includes an internal raised annular ring disposed about said support structure on said surface, said internal raised annular ring adapted to support said disc-shaped media above said surface.

29. The device of claim 21, wherein disc storage device further includes an external raised annular ring disposed about the periphery of said surface, said internal raised annular ring adapted to support said disc-shaped media above said surface.

30. The device of claim 21, wherein disc storage device further includes an internal raised annular ring disposed about said support structure on said surface and an external raised annular ring disposed about the periphery of said surface, said raised annular rings adapted to support said disc-shaped media above said floor.

31. The device of claim 30, wherein said disc storage device further includes a raised shoulder running around the perimeter of said surface, said shoulder serving to define said cavity and further serving to provide edge protection for said disc-shaped media.

32. The device of claim 31, further including a cover for said disc storage device.

33. The device of claim 31, further including a protective element adapted to prevent damage to said disc-shaped media.

34. A packaging device for packaging a media disk together with at least two containers for storage of materials other than said media disk, said at least two containers each having a top cover, said packaging device comprising:

a disc-shaped media having a central hole therein and an outer edge;

a disc storage device including a cavity having an opening therein for receiving said disc-shaped media, said disc storage device including means for retaining said disc-shaped media against lineal movement within said cavity while simultaneously allowing said disc-shaped media to rotate; and means for attaching said disc storage device to said at least two containers about said top cover and for simultaneously positively juxtaposing said at least two containers relative to each other.

35. The device of claim 34, wherein said cavity is bounded at one end by a surface, and wherein said retaining means comprises a support structure extending from said surface, wherein said support structure includes means adapted to be inserted through said hole so as to support and positively receive and retain said disc-shaped media.

36. A method for packaging disc-shaped media together with materials other than said disc-shaped media, said materials being stored in at least one container having a top cover, wherein said disc-shaped media is larger in diameter than at least one dimension of said top cover, said method comprising the steps of:

providing a packaging device comprising:

a disc storage device including a cavity having an opening therein for receiving said disc-shaped media, said disc storage device including means for retaining said disc-shaped media against lineal movement within said cavity while simultaneously allowing said disc-shaped media to rotate; and means for attaching said container to said at least one container about said top cover;

inserting said disc-shaped media into said cavity;

engaging said means for retaining said disc-shaped media; and removably attaching said disc storage device to said at least one container about said top cover.

37. The method of claim 36, wherein disc storage device further includes an internal raised annular ring disposed about said support structure on said surface, said internal raised annular ring adapted to support said disc-shaped media above said surface, wherein said step of engaging comprises mounting said disc-shaped media on said internal raised annular ring.

38. The method of claim 37, wherein disc storage device further includes an external raised annular ring disposed about the periphery of said surface, said internal raised annular ring adapted to support said disc-shaped media above said surface, wherein said step of engaging further comprises abutting said external raised annular ring.

39. The method of claim 38, wherein said disc storage device further includes a raised shoulder running around the perimeter of said surface, said shoulder serving to define said cavity and further serving to provide edge protection for said disc-shaped media, wherein said step of engaging further comprises positioning said disc-shaped media within said shoulder.

40. The method of claim 36, wherein said disc storage device further includes a downwardly extending skirt member, said skirt member being adapted to fit to the contours of said top cover, wherein said disc storage device may be secured within said top cover by means of engagement between said skirt member and said top cover, wherein said step of removably attaching comprises engaging said skirt with said top cover.

41. A method for packaging disc-shaped media together with materials other than said disc-shaped media, said materials being stored in at least one container having a top cover, wherein said disc-shaped media is larger in diameter than at least one dimension of said top cover, said method comprising the steps of:

providing a packaging device comprising:

a disc storage device including a cavity having an opening therein for receiving said disc-shaped media, said disc storage device including means for retaining said disc-shaped media against lineal movement within said cavity while simultaneously allowing said disc-shaped media to rotate; and means for attaching said container to said at least one container about said top cover;

removably attaching said disc storage device to said at least one container about said top cover; and inserting said disc-shaped media into said cavity; and engaging said means for retaining said disc-shaped media.

42. The method of claim 41, wherein disc storage device further includes an internal raised annular ring disposed about said support structure on said surface, said internal raised annular ring adapted to support said disc-shaped media above said surface, wherein said step of engaging comprises mounting said disc-shaped media on said internal raised annular ring.

43. The method of claim 42, wherein disc storage device further includes an external raised annular ring disposed about the periphery of said surface, said internal raised annular ring adapted to support said disc-shaped media above said surface, wherein said step of engaging further comprises abutting said external raised annular ring.

44. The method of claim 43, wherein said disc storage device further includes a raised shoulder running around the perimeter of said surface, said shoulder serving to define said cavity and further serving to provide edge protection for said disc-shaped media, wherein said step of engaging further comprises positioning said disc-shaped media within said shoulder.

45. The method of claim 41, wherein said disc storage device further includes a downwardly extending skirt member, said skirt member being adapted to fit to the contours of said top cover, wherein said disc storage device may be secured within said top cover by means of engagement between said skirt member and said top cover, wherein said step of removably attaching comprises engaging said skirt with said top cover.

46. A method for packaging disc-shaped media together with materials other than said disc-shaped media, said materials being stored in at least two containers each having a top cover, said method comprising the steps of:

providing a packaging device comprising:

a disc storage device including a cavity having an opening therein for receiving said disc-shaped media, said disc storage device including means for retaining said disc-shaped media against lineal movement within said cavity while simultaneously allowing said disc-shaped media to rotate; and means for attaching said disk-storage device to said at least two containers about said top cover and for simultaneously juxtaposing said at least two containers relative to each other;

aligning said at least two containers;

removably attaching said disc storage device to said at least two containers about said top cover; and inserting said disc-shaped media into said cavity; and engaging said means for retaining said disc-shaped media.

47. The method of claim 46, wherein disc storage device further includes an internal raised annular ring disposed about said support structure on said surface, said internal raised annular ring adapted to support said disc-shaped media above said surface, wherein said step of engaging comprises mounting said disc-shaped media on said internal raised annular ring.

48. The method of claim 47, wherein disc storage device further includes an external raised annular ring disposed about the periphery of said surface, said internal raised annular ring adapted to support said disc-shaped media above said surface, wherein said step of engaging further comprises abutting said external raised annular ring.

49. The method of claim 48, wherein said disc storage device further includes a raised shoulder running around the perimeter of said surface, said shoulder serving to define said cavity and further serving to provide edge protection for said disc-shaped media, wherein said step of engaging further comprises positioning said disc-shaped media within said shoulder.

50. The method of claim 46, wherein said disc storage device further includes a downwardly extending skirt member, said skirt member being adapted to fit to the contours of said top cover, wherein said disc storage device may be secured within said top cover by means of engagement between said skirt member and said top cover, wherein said step of removably attaching comprises engaging said skirt with said top cover.

51. A method for packaging disc-shaped media together with materials other than said disc-shaped media, said materials being stored in at least two containers each having a top cover, said method comprising the steps of:

providing a packaging device comprising:

a disc storage device including a cavity having an opening therein for receiving said disc-shaped media, said disc storage device including means for retaining said disc-shaped media against lineal movement within said cavity while simultaneously allowing said disc-shaped media to rotate; and means for attaching said disk-storage device to said at least two containers about said top cover and for simultaneously juxtaposing said at least two containers relative to each other;

inserting said disc-shaped media into said cavity;

engaging said means for retaining said disc-shaped media;

aligning said at least two containers; and removably attaching said disc storage device to said at least two containers about said top cover.

52. The method of claim 51, wherein disc storage device further includes an internal raised annular ring disposed about said support structure on said surface, said internal raised annular ring adapted to support said disc-shaped media above said surface, wherein said step of engaging comprises mounting said disc-shaped media on said internal raised annular ring.

53. The method of claim 52, wherein disc storage device further includes an external raised annular ring disposed about the periphery of said surface, said internal raised annular ring adapted to support said disc-shaped media above said surface, wherein said step of engaging further comprises abutting said external raised annular ring.

54. The method of claim 53, wherein said disc storage device further includes a raised shoulder running around the perimeter of said surface, said shoulder serving to define said cavity and further serving to provide edge protection for said disc-shaped media, wherein said step of engaging further comprises positioning said disc-shaped media within said shoulder.

55. The method of claim 51, wherein said disc storage device further includes a downwardly extending skirt member, said skirt member being adapted to fit to the contours of said top cover, wherein said disc storage device may be secured within said top cover by means of engagement between said skirt member and said top cover, wherein said step of removably attaching comprises engaging said skirt with said top cover.

* * * * *